US006076802A

United States Patent [19]

Maier

[11] Patent Number: 6,076,802

[45] Date of Patent: Jun. 20, 2000

[54] FUEL INJECTION VALVE

[75] Inventor: Dieter Maier, Gerlingen, Germany

[73] Assignee: Robert Bosch GmbH, Stuttgart, Germany

[21] Appl. No.: 09/297,693

[22] PCT Filed: Jun. 26, 1998

[86] PCT No.: PCT/DE98/01757

§ 371 Date: May 5, 1999

§ 102(e) Date: May 5, 1999

[87] PCT Pub. No.: WO99/13213

PCT Pub. Date: Mar. 18, 1999

[30] Foreign Application Priority Data

Sep. 6, 1997 [DE] Germany ..... 197 39 150

[51] Int. Cl.[7] ..... F02M 59/46

[52] U.S. Cl. ..... 251/129.21

[58] Field of Search ..... 251/129.14, 129.15, 251/129.21; 137/454.2, 454.4, 454.5, 454.6; 239/585.4

[56] References Cited

U.S. PATENT DOCUMENTS 4,782,853 11/1988 Moen ..... 137/454.6
4,971,291 11/1990 Cristiani et al. ..... 251/129.15
5,127,434 7/1992 Kline et al. ..... 251/129.21
5,375,623 12/1994 Weber ..... 137/454.5
5,462,231 10/1995 Hall ..... 251/129.21
5,632,467 5/1997 Just et al. ..... 251/129.21
5,718,206 2/1998 Sawada et al. ..... 251/129.14
5,860,632 1/1999 Buth et al. ..... 251/129.15
5,887,851 3/1999 Trzmiel ..... 251/129.15

*Primary Examiner*—Kevin Shaver
*Assistant Examiner*—Eric Keasel
*Attorney, Agent, or Firm*—Kenyon & Kenyon

[57] ABSTRACT

A fuel injection valve has a valve casing and a molded plastic sheathing which at least partially surrounds the valve casing, with sealing elements being provided on the outer circumference of the fuel injection valve for sealing the fuel injection valve with respect to a fuel rail; an intake manifold or the like. Each of the sealing elements has at least partial surface contact with the molded plastic sheathing, with the sealing elements being molded directly onto the molded plastic sheathing or molded into recesses in the molded plastic sheathing.

This fuel injection valve is suitable in particular for use in fuel injection systems of internal combustion engines with spark ignition and compression of a fuel-air mixture.

8 Claims, 1 Drawing Sheet

FUEL INJECTION VALVE

FIELD OF THE INVENTION

The present invention relates to a fuel injection valve.

BACKGROUND INFORMATION

Numerous fuel injection valves are already known, e.g., those disclosed in European Patent No. 0 348 786 or Unexamined German Patent No. 40 08 118, which have multiple sealing rings, usually designed as O rings, on their outer circumference. The geometric arrangement and position of these sealing rings which are independent parts and are assembled separately depends on the installation conditions on the internal combustion engine and the embodiments of the valves, which may be designed as top feed injectors or as bottom feed injectors, for example. With these conventional fuel injection valves, the seal to be achieved with the sealing rings is with respect to an intake manifold, a cylinder head or receiving sleeves or a fuel rail, a distributor line or the like. Sealing rings are introduced into specially designed mounting spaces, such as ring grooves, on the valve housing, on the nozzle body, on projecting bodies or on the molded plastic sheathing provided on the fuel injection valve.

German Patent No. 195 12 339 describes tube-like sealing elements which may be provided on fuel injection valves with a molded plastic sheathing so that they lie directly on metal parts of the valve at the ends of the molded plastic sheathing. The sealing elements here completely surround the respective metal part of the valve radially and are usually surrounded radially at least partially by the molded plastic sheathing.

SUMMARY OF THE INVENTION

The fuel injection valve according to the present invention has the advantage that an inexpensive as well as reliable and effective seal that can be produced easily is guaranteed for the fuel injection valve toward the outside, e.g., with respect to a fuel rail, a distributor line or an intake manifold or a cylinder head. The seal is provided by sealing elements according to the present invention which are produced in a plastic injection mold before, during or after producing the molded plastic sheathing around the fuel injection valve. With such a mold, a second injection operation takes place advantageously after injection molding of the plastic for the valve jacket, molding the sealing elements on the molded plastic sheathing so that a contact area is formed at least at the surface. A substantively engaged contact is formed in the contact areas of the sealing material of the sealing element with the plastic of the molded plastic sheathing. A very flexible design and spatial arrangement can be achieved in an especially advantageous manner by applying the sealing elements by injection.

It is advantageous that it is possible to vary in a very simple manner the number of sides of the sealing element to have surface contact with the molded plastic sheathing. A one-sided surface contact can be achieved at one end of the molded plastic sheathing, a two-sided surface contact can be achieved at a stepped section of the molded plastic sheathing, and a three-sided surface contact can be achieved in annular grooves on the outer circumference of the molded plastic sheathing.

The advantage of a very great variability of the installed position with one and the same valve is achieved with the arrangement of sealing elements in the middle axial areas of the fuel injection valve.

The thicknesses and widths (axial dimensions) of the sealing elements can be varied easily in an advantageous manner. In addition, a great variety of shapes can be produced easily, with convex, rounded or flat outside contours and contours provided with sealing lips or sealing ribs being advantageous.

DETAILED DESCRIPTION

Figure 1:
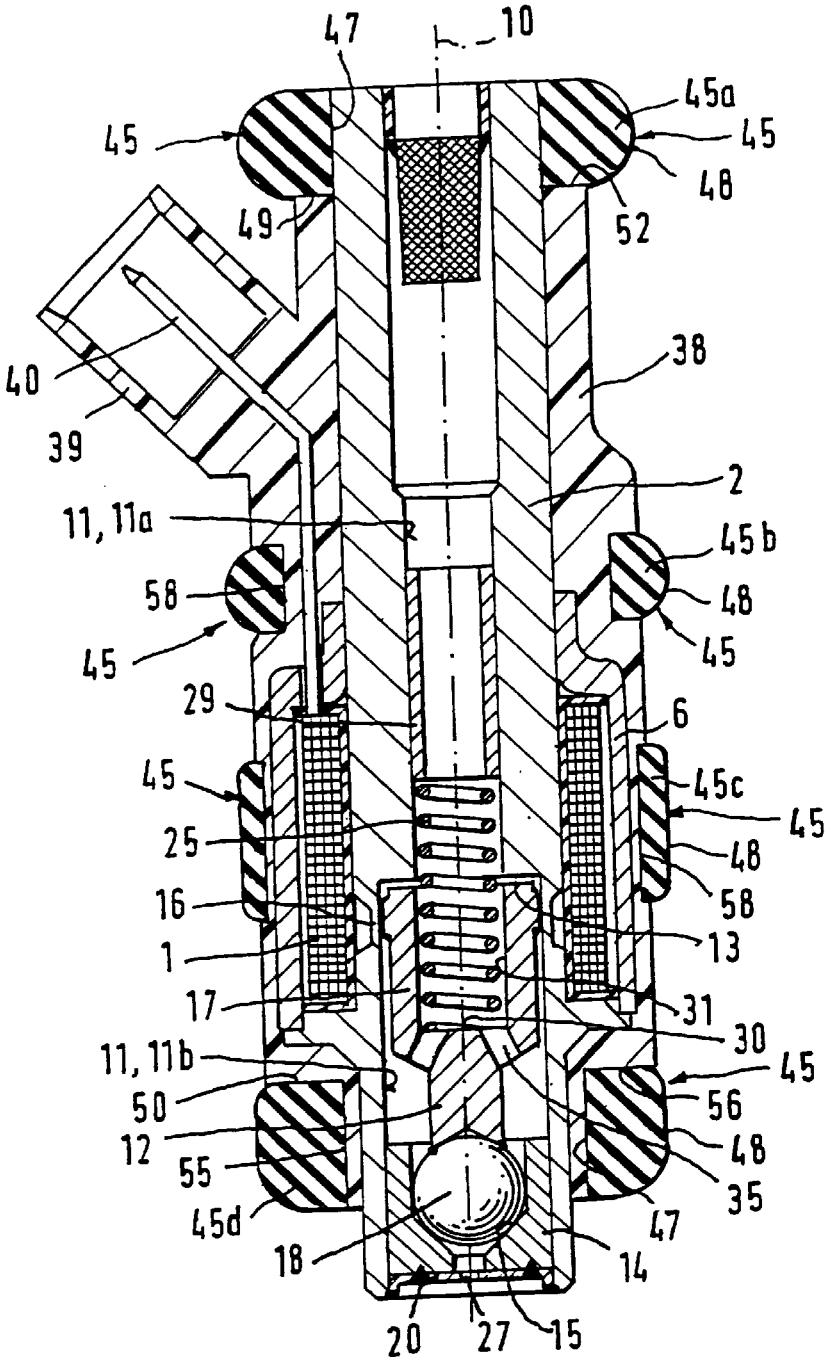
FIG. 1 shows a fuel injection valve with various sealing elements according to the present invention.

The fuel injection valve according to the present invention, illustrated in FIG. 1 as an example in a partially simplified form, for fuel injection systems of internal combustion engines with spark ignition and compression of a fuel-air mixture has a one-piece, mostly tubular metal base body 2 serving as the inside pole surrounded by a magnet coil 1 and also as a fuel inlet and flow passage and as a valve seat carrier. Base body 2 is designed with multiple steps and is largely a valve casing for the fuel injection valve. Magnet coil 1 is surrounded by at least one, e.g., two guide elements 6 designed as clamps and serving as ferromagnetic elements. Each guide element 6 surrounds magnet coil 1 partially in the circumferential direction and can be joined to base body 2 by welding, soldering or gluing at one end above magnet coil 1 and at another end below it.

Base body 2 has an internal longitudinal opening 11 running concentrically with a longitudinal axis 10 of the valve and serving as a fuel flow channel in an upstream area 11*a* and also, at least partially as a guide opening for a valve needle 12 movable axially along valve longitudinal axis 10, in a downstream area 11*b*. Area 11*b* has a larger diameter than area 11*a*, because a stepped shoulder 13 is provided in longitudinal opening 11 along magnet coil 1. Following directly downstream from stepped shoulder 13, base body 2 has a thin-walled magnetic throttle point 16.

On the downstream end of area lib of longitudinal opening 11 of base body 2 which serves as the valve seat carrier there is a valve seat body 14 having a fixed valve seat face 15 serving as the valve seat. Valve seat body 14 is fixedly joined to base body 2 with a weld produced with a laser, for example. Otherwise, lower area 11*b* of longitudinal opening 11 serves to accommodate valve needle 12 which is formed by an armature 17 and a spherical valve closing body 18. A flat spray hole disk 20 is arranged on the downstream end face of valve seat body 14. Armature 17 which serves as a carrier for the closing body is fixedly connected by a weld, for example, to spherical valve closing body 18 at its downstream end facing spray hole disk 20.

The injection valve is operated electromagnetically in the conventional manner. The electromagnetic circuit with magnet coil 1, inside base body 2, guide elements 6 and armature 17 serves to provide the axial movement of valve needle 12 and thus to open the injection valve against the spring force of a restoring spring 25 or to close it. Armature 17 is aligned with stepped shoulder 13 of base body 2 accordingly. Restoring spring 25 extends in longitudinal opening 11 both upstream and downstream of stepped shoulder 13, for example, i.e., in both areas 11*a* and 11*b*.

Spherical valve closing body 18 interacts with valve seat face 15 of valve seat body 14; this valve seat face tapers in the form of a truncated cone in the direction of flow and is formed axially downstream from a guide opening in valve seat body 14. Spray hole disk 20 has at least one spray opening 27, e.g., four spray openings formed by eroding or stamping.

The depth of insertion of valve seat body 14 in the injection valve is a deciding factor in determining the lift of valve needle 12. One end position of valve needle 12 when magnet coil 1 is not energized is determined by the contact of valve closing body 18 with valve seat face 15 of valve seat body 14, while the other end position of valve needle 12 when magnet coil 1 is energized is determined by the contact of armature 17 with stepped shoulder 13 of base body 2. The lift is set by an axial displacement of valve seat body 14, which is fixedly joined to base body 2 in accordance with the desired position subsequently.

In addition to restoring spring 25, an adjusting sleeve 29 is also inserted into upper area 11*a* of longitudinal opening 11. Adjusting sleeve 29 serves to adjust the pre-stress of restoring spring 25 which is in contact with adjusting sleeve 29 and whose opposite end rests on a bottom area 30 of an inside recess 31 in armature 17, so the dynamic spray volume is also adjusted with adjusting sleeve 29.

At least one through hole 35 is provided in armature 17 starting from bottom area 30 of recess 31; for example, two or four through holes 35 may extend outward at an angle to valve axis 10. In the area of through holes 35, armature 17 tapers in the downstream direction, its outside contour being in the form of a truncated cone. This design of armature 17 makes it possible for the fuel supplied to valve seat face 15 to flow unhindered first inside valve needle 12 through recess 31 and then outside valve needle 12 after coming out of through holes 35.

This fuel injection valve is largely surrounded by a molded plastic sheathing 38 which extends axially almost completely over base body 2 and also guide elements 6. This molded plastic sheathing 38 also includes, for example, an electric plug connector 39 which is molded with it; for example, two contact pins 40 coming from magnet coil 1 end in this connector. Magnet coil 1 is electrically contacted and thus energized through electric plug connector 39.

To seal the fuel injection valve on the inlet end with respect to a fuel rail, a distributor line or the like and at the outlet end with respect to an intake manifold, a connection provided there or a cylinder head of an internal combustion engine, sealing elements 45, 45*a–d* connected to the molded plastic sheathing 38 are provided on the outer circumference of the fuel injection valve; these are not sealing parts that can be installed independently. Instead, these sealing elements 45 are molded before, directly with or after applying molded plastic sheathing 38. A two-component injection technique is required for such a procedure.

An especially preferred procedure is described in detail below. After molded plastic sheathing 38 has been applied to metal base body 2 in a convention manner with the help of a plastic injection mold, a second injection molding operation is performed with the same mold to produce sealing elements 45. To do so, the bolts present at the sites of sealing elements 45 that are to be produced are removed when injecting the plastic into the plastic injection mold. At the time of the second molding operation, molded plastic sheathing 38 must already have a certain stability and dimensional accuracy, with the plastic still being soft enough to achieve an optimum substantively engaged contact with the material of desired sealing elements 45. Suitable materials for sealing elements 45 include in particular various types of rubber (elastomers) or elastic plastics such as those known for O rings or other sealing rings on injection valves. In an especially advantageous manner, a very flexible shaping and spatial arrangement can be achieved in the design of sealing elements 45 by molding them with the sheathing.

FIG. 1 shows several examples with regard to the shape and arrangement of sealing elements 45, labeled with suffixes a through d, on the fuel injection valve. It is possible to provide only a single sealing element 45 on the fuel injection valve; however, multiple sealing elements 45 shaped according to the present invention may also be provided on one and the same fuel injection valve. This may be varied according to the installation conditions. Sealing element 45*a* on the upper inlet end of molded plastic sheathing 38 is molded, for example, so that it is in direct contact with base body 2 on a flat inside 47 while on the other hand being available with a convex outside 48 for sealing another part (e.g., a fuel rail). With a bottom side 49, sealing element 45*a* also has direct surface contact with a top end face 52 of molded plastic sheathing 38.

Another variant of the molding of sealing element 45 is shown on the outlet end of molded plastic sheathing 38, with sealing element 45*d* being molded directly on molded plastic sheathing 38, namely in a stepped section 55 provided for this purpose. Then with its flat inside 47, sealing element 45*d* is in contact with molded plastic sheathing 38, while the at least partially convex outside 48 is available for sealing with respect to another part (e.g., an intake manifold). Sealing element 45*d* is also in direct contact with a shoulder 56 of stepped section 55 of molded plastic sheathing 38 with its flat top side 50. In contrast with sealing element 45*a*, sealing element 45*d* thus has two contact faces with molded plastic sheathing 38.

Two additional variants for the design of a sealing element 45 on the circumference of the fuel injection valve and specifically on the circumference of molded plastic sheathing 38 are illustrated with sealing elements 45*b* and 45*c*. Ring grooves 58 are provided in molded plastic sheathing 38 to accommodate sealing elements 45*b* and 45*c;* sealing elements 45*b* and 45*c* are injected directly into these ring grooves. These ring grooves 58 are located in the middle part of the axial extent of molded plastic sheathing 38, e.g., in the area of magnet coil 1 or adjusting sleeve 29. A substantively engaged surface contact of insides 47 of sealing elements 45 with molded plastic sheathing 38 is achieved at least at the base of ring grooves 58. Outsides 48 of sealing elements 45 may be convex (sealing element 45*b*) or partially flat with rounding in edge areas (sealing element 45*c*) or completely flat. As FIG. 1 shows, the thicknesses and widths (axial extent) of sealing elements 45 can be varied slightly.

The arrangement of such middle sealing elements 45*b* and 45*c* yields the advantage of a very great variability in installed position with one and the same fuel injection valve. For example, without any changes in the valve group (e.g., on base body 2 or on valve needle 12) the spray point can be moved forward with such a valve at any time if needed by simply inserting the valve farther into the intake manifold. The seal on the side of the intake manifold is then provided by sealing element 45*c*, for example, instead of sealing element 45*d*. Since sealing elements 45 can be designed very easily with different thicknesses, it is possible to use different sealing elements 45*b*, 45*c*, 45*d* for sealing with respect to the opening in an intake manifold connection with a constant diameter despite differences in valve outside diameter (e.g., largest diameter in the area of magnet coil 1, smallest diameter in the area of valve closing body 18).

Sealing elements 45 may also have contours other than those illustrated in FIG. 1. For example, multiple sealing lips

Figure 2:
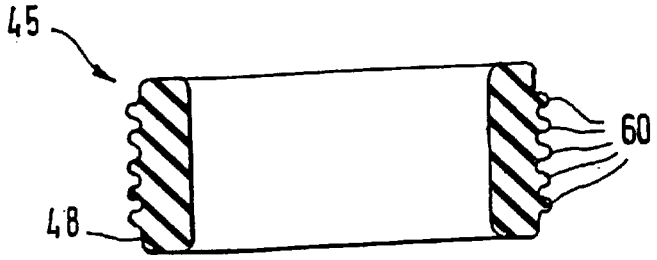
FIG. 2 shows a sealing element with several sealing lips.

60 or sealing ribs may be provided on outsides 48 of sealing elements 45, as indicated by sealing element 45 illustrated in FIG. 2. Individual sealing lips 60 run on the outside circumference of sealing element 45 in the form of a ring, for example. It should be pointed out that sealing element 45 is shown as a separate part, separated from molded plastic sheathing 38, only to better illustrate its geometry, but it is not an independently assembled sealing part according to the present invention.

What is claimed is:

1. A fuel injection valve for a fuel injection system of an internal combustion engine, comprising:

a valve casing;

a fixed valve seat;

a valve needle axially moving along a longitudinal axis of the valve;

a valve closing body interacting with the fixed valve seat to open and close the fuel injection valve;

sealing elements sealing the fuel injection valve to an external portion of the fuel injection valve; and a molded plastic sheathing at least partially surrounding the valve casing, wherein at least one of the sealing elements has a substantially engaging surface contact with the molded plastic sheathing by molding the at least one of the sealing elements and the molded plastic sheathing onto one another.

2. The fuel injection valve according to claim 1, wherein the sealing elements are composed of an elastomer.

3. The fuel injection valve according to claim 1, wherein each of the sealing elements has an outside portion which faces away from the longitudinal axis, the outside portion having shape which is at least partially convex.

4. The fuel injection valve according to claim 1, wherein at least one of the sealing elements has a top side and a bottom side, the top side and the bottom side being situated substantially perpendicular to an inside portion of the at least one of the sealing elements and facing the longitudinal axis, at least one of the sealing elements being molded onto the molded plastic sheathing so that only one of the top side and the bottom side has the substantially engaging surface contact with the molded plastic sheathing.

5. The fuel injection valve according to claim 1, wherein a particular element of the sealing elements is injected in a circumferential ring groove so that at least one inside portion of the particular element has the substantially engaging surface contact with the molded plastic sheathing, the at least one inside portion facing the longitudinal axis, the circumferential ring groove being situated on a circumference of the molded plastic sheathing.

6. The fuel injection valve according to claim 1, wherein at least one of the sealing elements is embedded in a stepped section of the molded plastic sheathing so that at least two sides of the at least one of the sealing elements are in a surface contact with the molded plastic sheathing.

7. The fuel injection valve according to claim 1, wherein at least one of the sealing elements includes sealing lips, the sealing lips being situated on an outside portion of the at least one of the sealing elements, the outside portion facing away from the longitudinal axis.

8. The fuel injection valve according to claim 7, wherein the sealing lips are situated around the outside portion in an annular configuration.

* * * * *